US005481863A

United States Patent [19]

Ota

[11] Patent Number: 5,481,863

[45] Date of Patent: Jan. 9, 1996

[54] SPINNING DEVICE HAVING SPACED APART FRONT ROLLERS AND DELIVERY ROLLERS

[75] Inventor: Naritoshi Ota, Ohtsu, Japan

[73] Assignee: Murata Kikai Kabushiki Kaisha, Kyoto, Japan

[21] Appl. No.: 103,973

[22] Filed: Aug. 9, 1993

[30] Foreign Application Priority Data

Aug. 28, 1992 [JP] Japan ..... 4-230005

[51] Int. Cl.[6] ..... D01H 13/04; D01H 15/00

[52] U.S. Cl. ..... 57/328; 57/315; 57/330; 57/333

[58] Field of Search ..... 57/328, 315, 330, 57/333, 211

[56] References Cited

U.S. PATENT DOCUMENTS

| | | | |
|---|---|---|---|
| 4,399,648 | 8/1983 | Kato | 57/328 |
| 4,429,523 | 2/1984 | Kajita et al. | 57/328 |
| 4,598,537 | 7/1986 | Kroupa et al. | 57/315 X |
| 4,942,731 | 7/1990 | Morihashi et al. | 57/315 |
| 5,237,810 | 8/1993 | Stadler et al. | 57/328 |

FOREIGN PATENT DOCUMENTS

| | | | |
|---|---|---|---|
| 372255 | 6/1990 | European Pat. Off. | 57/328 |

*Primary Examiner*—William Stryjewski
*Attorney, Agent, or Firm*—Loeb and Loeb

[57] ABSTRACT

A spinning device for producing a spun yarn from a staple fiber bundle. A staple fiber bundle is supplied to a spinning nozzle via the front rollers of a draft unit. A pair of delivery rollers is positioned downstream from the spinning nozzle and spaced from the front rollers by a distance that is shorter than the length of the longest fibers in the staple fiber bundle.

2 Claims, 2 Drawing Sheets

SPINNING DEVICE HAVING SPACED APART FRONT ROLLERS AND DELIVERY ROLLERS

PRIOR ART

The present invention relates to a spinning device which produces spun yarn by feeding a staple fibre bundle from the front rollers of the draft unit and introducing it into a spinning nozzle, which spins the yarn by means of air acting upon it.

Because it is necessary in this type of spinning method, to balloon the yarn by means of the spinning nozzle, the speed of the delivery rollers is slightly less than that of the front rollers.

When the front rollers and delivery rollers get near to one another, ballooning of the yarn becomes difficult and this is thought to be the cause of faulty spinning and yarn breakage, so that in a spinning device using this type of spinning method, the front rollers and delivery rollers are arranged so that there is sufficient space between them.

However, in a conventional spinning device as mentioned above, yarn breakages is a frequent occurance, especially when long fibers such as wool are used.

SUMMARY OF THE INVENTION

The purpose of the present invention is to improve the productivity of a spinning device and to improve the quality of the yarn by reducing significantly the occurrence of yarn breakage occurring between the front and delivery rollers.

In order to achieve the abovementioned purpose, the spinning device of the present invention is the distance between the front rollers of the draft unit and the delivery rollers, which pull the spinning yarn is set so that it is shorter than the length of the longest fibers which are being supplied between them.

DETAILED DESCRIPTION OF A PREFERRED EMBODIMENT

Figure 1:
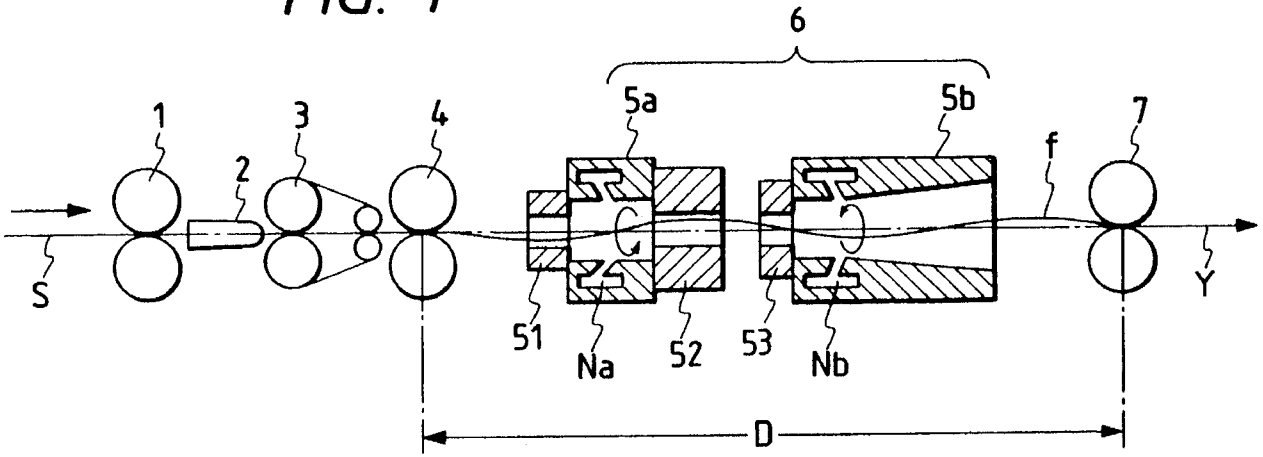
FIG. 1 is an outline view, including a cross section, of the spinning device of the present invention.

Following is a description of a preferred embodiment of the present invention by reference to FIG. 1.

Figure 3:
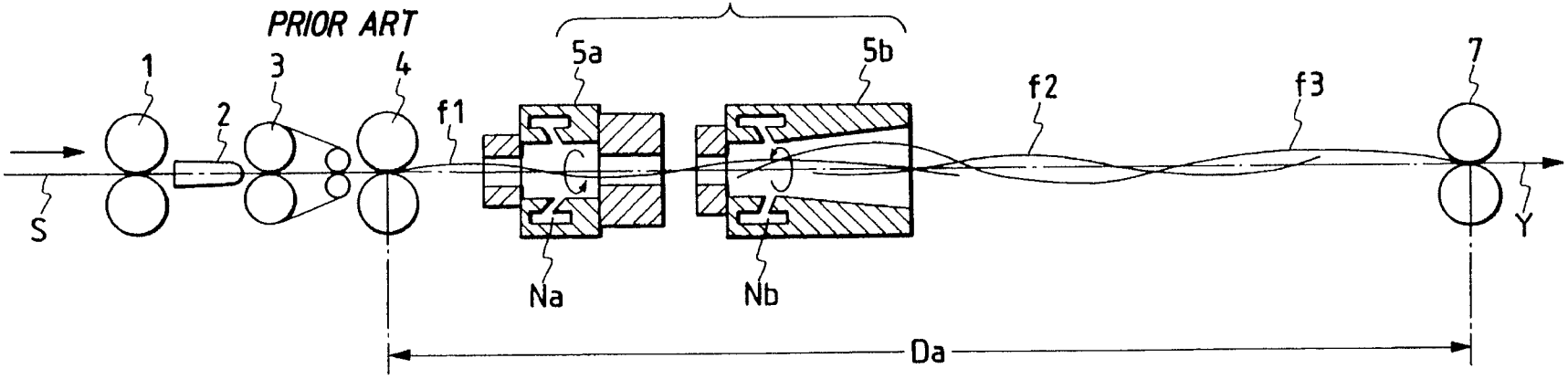
FIG. 3 PRIOR ART
FIG. 3 is the outline view, including a cross section of a conventional spinning device.

In FIG. 1, 1, 3 and 4 are respectively the back rollers, apron rollers and front rollers constituting a commonly known draft unit and 2 is the condenser.

In FIG. 1, 6 are the spinning nozzles, constituted by the first nozzle 5*a* and second nozzle 5*b* containing respectively air jet nozzles Na and Nb. The air nozzles Na and Nb are respectively arranged in the first nozzle 5*a* and second nozzle 5*b* so that they jet air so that the whirling air from the first nozzle 5*a* and the whirling air from the second nozzle 5*b* reverses direction each other. 51, 52 and 53 are respectively the balloon control rings and are provided to throttle ballooning of the yarn and to control the ballooning.

In FIG. 1, 7 is the delivery roller which draws the spun yarn Y and S is the staple fiber bundle (sliver).

The distance D between the front rollers 4 and the delivery rollers 7 is set so that it is shorter than the length of the longest fiber f constituting the staple fiber bundle S. For example, in the case of producing the long fiber yarn such as worsted yarn and synthetic yarn, the longest length of the fibers actually supplied is almost, between 150 mm and 190 mm, so the above distance D is set shorter than this.

The present embodiment will be described below in further detail while comparing it to the case shown in FIG. 3 in which the distance Da between the front rollers 4 and delivery rollers 7 is longer than the length of the longest fiber.

The staple fiber bundle S is introduced from the front rollers 4 in the draft unit into the second nozzle 5*b* via the first nozzle 5*a* and is false twisted by air action of the jet nozzle Nb in the second nozzle 5*b* so that its false twist reaches the nip point of the front rollers 4.

On the other hand, the staple fiber bundle S is ballooned in the space between the front roller 4 and the first nozzle 5*a* in the opposite direction to the abovementioned false twist by the air jet from nozzle Na in the first nozzle 5*a* and by means of this ballooning, the ends of the fibers making up the surface section of the staple fiber bundle are loose (hereinafter these loose ends are referred to as open end fibers).

The open end fibers which form the circumference of the staple fiber bundle S pass through the second nozzle 5*b* which false twists them and then at the untwisting is step wound around the core fiber which has been untwisted in the opposite direction to the false twist. Then the spun yarn composed of the core fiber and wound fiber is completed.

The spun yarn Y which passes through the delivery rollers 7 is wound around the package by means of an ordinary winding device, not shown.

The spun yarn Y which is formed in this way, is untwisted or the open end fibers are wound between the second nozzle 5*b* and delivery rollers 7 until it passes through the delivery rollers 7 and consequently, the space between the front rollers 4 and the delivery rollers 7 becomes the region for forming spun yarn Y.

Further, in this space, the spun yarn Y is effected by the air jet nozzle Na of the first nozzle 5*a* and the air jet nozzle Nb of the second nozzle 5*b* and because there is torque in the spun yarn while it remains inside, until it goes through the delivery rollers 7 the fibers constituting the spun yarn Y are not stable and consequently, yarn end breakage to the spun yarn Y easily occurs in the space between the front rollers 4 and the delivery rollers 7.

As shown in FIG. 3, when the distance Da between the front rollers 4 and the delivery rollers 7 is set longer than the length of the longest fiber of the fibers supplied f1, f2 or f3, during the yarn formation step occurring between the front rollers 4 and delivery rollers 7, there are fibers which are either grasped only by the front rollers 4 (fiber f1), grasped only by the delivery rollers 7 (fiber f3) or grasped by neither the front rollers 4 nor delivery rollers 7, and floating (fiber f2) and there are no fibers being grasped by both the front rollers 4 and the delivery rollers 7.

As a result, in a spinning device which increases the distance Da as above, during the yarn formation step occurring between the front rollers 4 and the delivery rollers 7, because of the disorders of ballooning, there are problems such as too much sliding of the fiber constituting the spun yarn Y, and yarn breakages can easily occur.

As opposed to this, in the present invention, as shown in FIG. 1, because the length of the space D between the front rollers 4 of the draft section and the delivery rollers 7 which pull the spun yarn is set shorter than the length of the longest fiber of fiber f constituting the staple fiber bundle S which is supplied, in the space between the front rollers 4 and the delivery rollers 7, there is a percentage of fibers that will at the same time be grasped by both the front rollers and the delivery rollers 7.

Accordingly constituted, because normally, at the same time there will a percentage of fibers being grasped by both the front rollers 4 and the delivery rollers 7, in the space between the front rollers 4 and the delivery rollers 7 there can be, for example, marked reduction in the occurrence of yarn breakage caused by problems such as ballooning disorders, making it possible to produce a spun yarn which is stable.

It is desirable to have 15 percent or less of the total fibers being grasped by both the front rollers 4 and the delivery rollers 7 because when there are more than 15 percent, it is difficult to get open end fibers and this hinders the formation of the yarn.

What is the ideal percentage within this 15 percent range is based on the type of staple fiber bundle being supplied and other factors such as the draft ratio and yarn spinning speed and can be adjusted theoretically or on the bases of trial and error.

Figure 2:
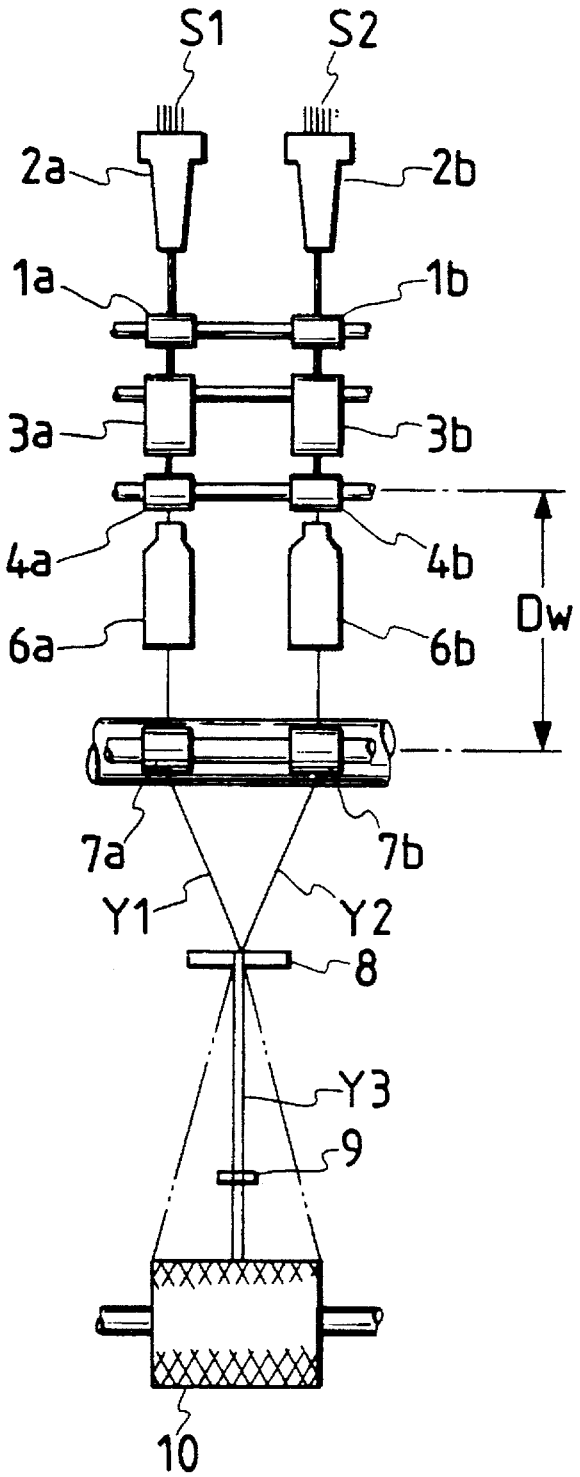
FIG. 2 is the front view of the two ply yarn spinning device.

Following the preferred embodiment of a two ply yarn spinning device of the present invention will be explanation with reference to FIG. 2.

In FIG. 2, S1, and S2 are the staple fiber bundles and 2*a* and 2*b* are the trumpet guides. Further 1*a*, 1*b*, 3*a*, 3*b* and 4*a* and 4*b* are each identical to the back roller, apron roller and front roller constituting a familiar draft unit and which is shown in FIGS. 1 and 3. 6*a* and 6*b* are each spinning nozzles having the constitution shown in FIGS. 1 and 3.

7*a* and 7*b* are the delivery rollers provided above the axis line extension of each of the spinning nozzles 6*a* and 6*b* and down stream in the direction the yarn is running from each of the spinning nozzles 6*a* and 6*b*. 8 is the yarn doubling guide arranged downstream in the direction the yarn is running from the delivery rollers 7*a* and 7*b*, further upstream than the traverse guide 9. Further, 10 is the package which is wound with two ply yarn Y3 by means of the traverse guide 9.

As shown in the above each of yarn paths of the spun yarns Y1 and Y2 which are introduced from each of the spinning nozzles 6*a* and 6*b* are maintained in a straight line up until they pass through the delivery rollers 7*a* and 7*b* which are provided corresponding to each spinning nozzle 6*a* and 6*b* and after they have passed through the delivery nozzles 7*a* and 7*b*, two spun yarns Y1 and Y2 are combined by means of the yarn doubling guide 8 and are composed as a single two ply yarn Y3.

The spun yarns Y1 and Y2 are still not fully formed before they go through the delivery rollers 7*d* and 7*b* and they are not stable. Because of this, if the yarn is passed between the spinning nozzle and the delivery roller without bending, it is possible to decrease the amount of yarn breakage.

In this embodiment, the distance Dw between the front rollers 4*a* and 4*b* and the delivery rollers 7*a* and 7*b* of the abovementioned two ply yarn spinning device is set shorter than the length of the longest fiber of the fibers constituted by the staple fiber bundles S1 and S2 being supplied and in the space between the front rollers 4*a* and 4*b* and the delivery rollers 7*a* and 7*b*, this embodiment is constituted so that a percentage of fibers are grasped by both the front rollers 4*a* and 4*b* and the delivery rollers 7*a* and 7*b*. Being constituted in this way, the occurrence of yarn breakages between the front rollers 4*a* and 4*b* and the delivery rollers 7*a* and 7*b* of the two ply yarn spinning device can be reduced.

Furthermore, in the two ply yarn spinning device mentioned above, until the spun yarns Y1 and Y2 pass through the delivery rollers 7*a* and 7*b*, because this device is constituted so that the spun yarns Y1 and Y2 are maintained in a straight line, and furthermore, because the distance Dw between the abovementioned front rollers 4*a* and 4*b* and delivery rollers 7*a* and 7*b* is set so that it is shorter than the length of the longest fiber constituting the staple fiber bundles S1 and S2 which are supplied, the amount of yarn breakages is significantly decreased. A yarn guide of a yarn surveillance device can be used as the doubling guide 8.

In the present invention, according to the abovementioned constitution, there is a marked reduction in yarn breakages occurring in the region in which the yarn forming step takes place, that is, between the front roller section and the delivery rollers which pull the spun yarn, so that the productivity of the spinning device is significantly improved.

What is claimed is:

1. A ply yarn spinning device for producing a plurality of spun yarns from staple fiber bundles and doubling together the plurality of spun yarns to produce a ply yarn, the device comprising:

a plurality of spinning nozzle defining a fiber travel direction, each of spinning nozzles defining an axis, a draft unit having a corresponding plurality of front roller pairs for supplying stable fibers to the spinning nozzles, a corresponding plurality of delivery roller pairs, each of the delivery roller pairs being positioned downstream from a corresponding spinning nozzle in the fiber travel direction and spaced from a corresponding front roller pair by a distance that is shorter than the length of the longest fibers in the staple fiber bundle, each of the delivery roller pairs being located along the axis defined by the corresponding spinning nozzle, each yarn path is maintained in a substantially straight line until the spun yarn coming from each of the spinning nozzles passes through the delivery rollers, and means position downstream from said delivery roller pairs in the fiber travel direction for combining yarn from said delivery roller pairs together to form a ply yarn, whereby yarn breakage is reduced.

2. The device of claim 1, comprising a yarn doubling guide provided downstream from the delivery roller pairs.

* * * * *